United States Patent [19]

Brown

[11] 4,375,740

[45] * Mar. 8, 1983

[54] PORTABLE ABRADING CABINET DEVICE FOR RECYCLING ABRASIVE BLASTING SYSTEM

[75] Inventor: Donald J. Brown, Naperville, Ill.

[73] Assignee: JPD Manufacturing Limited, Itasca, Ill.

[ * ] Notice: The portion of the term of this patent subsequent to Nov. 11, 1997, has been disclaimed.

[21] Appl. No.: 203,714

[22] Filed: Nov. 3, 1980

Related U.S. Application Data

[63] Continuation-in-part of Ser. No. 909,537, May 25, 1978, Pat. No. 4,232,487.

[51] Int. Cl.[3] ..... B24C 3/06

[52] U.S. Cl. ..... 51/425; 51/427

[58] Field of Search ..... 51/424, 425, 427, 428, 51/429, 439

[56] References Cited

U.S. PATENT DOCUMENTS

| | | | |
|---|---|---|---|
| 847,269 | 3/1907 | Wise | 51/438 X |
| 2,597,434 | 5/1952 | Bishop et al. | 51/438 X |
| 2,628,456 | 2/1953 | Berg | 51/424 |
| 2,723,498 | 11/1955 | Hastrup et al. | 51/427 X |
| 2,770,924 | 11/1956 | Mead et al. | 51/427 |
| 2,810,991 | 10/1957 | Mead et al. | 51/427 X |
| 3,599,375 | 8/1971 | Nusemaker | 51/429 X |
| 3,624,967 | 12/1971 | Kamper et al. | 51/425 X |
| 3,906,673 | 9/1975 | Goto et al. | 51/425 X |
| 3,934,372 | 1/1976 | Diehn et al. | 51/425 |
| 4,020,596 | 5/1977 | Bergh | 51/425 |
| 4,045,915 | 9/1977 | Gilbert et al. | 51/427 |
| 4,212,138 | 7/1980 | Hutchison | 51/427 |
| 4,232,487 | 11/1980 | Brown | 51/425 |
| 4,281,485 | 8/1981 | Charity | 51/425 |
| 4,300,318 | 11/1981 | Brown | 51/425 |

*Primary Examiner*—James G. Smith

*Attorney, Agent, or Firm*—Wegner, McCord, Wood & Dalton

[57] ABSTRACT

A portable abrading cabinet device is provided for use in a recycling abrasive blasting system. The cabinet device includes a cup-shaped housing affording an inner blasting chamber. The forward open end of the housing has a peripheral resilient seal to provide airtight engagement with the surface to be abraded. The housing has an inlet aperture for the barrel of a sand blasting gun which delivers rapidly moving abrasive material to the surface to be worked. A funnel-shaped exhaust means in the housing terminates in a fitting which detachably receives a conduit connected to accommodate an external source of vacuum so that spent abrasive and debris may be removed from the inner blasting chamber of the cabinet housing. A transparent window member in the housing permits an operator to observe the abrading operation, the window member being partially shielded by a pair of deflectors which redirect ricocheting abrasive and debris within the cabinet housing. To further aid the observation of the operation, illuminating means are provided within the cabinet. The abrasive is introduced into, and recycled from, the cabinet housing by an appropriate external blasting system.

8 Claims, 6 Drawing Figures

AIR
GRIT
GRIT
VAC.

72
43
70
70d
45
58
58a
55
59
53
58a
58
57
45
44
41
47
50
52
51
54
54a
56
5.
5.
71
71
71
70a
83
84
80
81
84
46
42
40
72
70b
70
60
61
63

72
70a
70
71
47
82
70b
60
63
46
51
50
52
71

72
71

PORTABLE ABRADING CABINET DEVICE FOR RECYCLING ABRASIVE BLASTING SYSTEM

CROSS-REFERENCE TO RELATED APPLICATION

This application is a continuation-in-part of my copending application Ser. No. 909,537, filed May 25, 1978, entitled ABRADING DEVICE, now U.S. Pat. No. 4,232,487.

BACKGROUND OF THE INVENTION

1. Field of the Invention

This invention relates to abrasive blasting systems and more particularly to a portable abrading cabinet device for use in a recycling type of abrasive blasting system, the abrading operation being performed within the portable cabinet device when the device is placed against the surface to be worked.

2. Description of the Prior Art

The use of abrasive, such as particles of sand or grit, to burnish or remove the finish from a surface is known. In operations, such as sandblasting, the sand is propelled against the work surface in a stream or current of high velocity air which carried the sand and is directed at the surface. The impingement of the sand against the work surface wears away or erodes the top layer of the work. Typically, the sand is widely scattered so that it is wasted. Further, the wasted sand and the debris from the work surface pollutes or otherwise contaminates the surrounding area.

Enclosures have been employed to contain the abrasive within the work area. Such enclosures have included small shrouds surrounding the sandblasting gun and positioned against a work surface to be abraded for capturing spent sand and debris and systems for recirculating the captured sand for reuse. Such shrouds have been opaque throughout so that the shrouds must be removed from the work surface to observe the effects of the abrading operation.

Large enclosures have also been used having interiors which can be viewed during a blasting operation; however, articles to be abraded must be of a size to fit within the enclosure being used. Additionally, the abrasive blasting systems and large enclosures employed in the prior art have been relatively intricate in design and structure, and, as a result, the prior art devices have been relatively expensive.

SUMMARY OF THE INVENTION

The above copending application discloses a recycling type of abrasive blasting system which recaptures, recirculates and reuses abrasive materials directed against a surface to be abraded.

The present invention discloses a portable abrading cabinet device which can be compatibly used as an accessory in such an abrasive blasting system. The abrading operation is performed upon a surface area enclosed by the skirt-like sidewall of the cabinet.

The abrasive blasting system of the copending application includes a housing or canister containing a supply of abrasive material and having an outlet for abrasive at its bottom, a source of vacuum connected to the top of the housing for creating a negative pressure above the upper surface layer of the abrasive material in the housing, a gun having a barrel for directing abrasive material into the portable cabinet in the direction of a surface area to be abraded and having a passageway therethrough, a source of positive pressure air connected to one end of said gun passageway, a first low-pressure conduit connected to the top of the housing above said abrasive material and to the portable cabinet for returning abrasive material and abraded debris from the abraded surface area to the housing, a second conduit connected between the housing outlet and the gun passageway downstream of the connection of the source of positive pressure to the gun, and means for causing abrasive material to flow toward the gun in said second conduit.

In an exemplary embodiment of the invention, the portable cabinet device has a cup-shaped cabinet housing which is open at its forward end portion and affords an inner blasting chamber. An aperture is provided in the housing to pivotally receive the gun barrel from the abrasive source. To observe the abrading operation, a window element is mounted within the cabinet housing. An exhaust outlet means in the housing is adapted for connection to the low-pressure conduit for removal of spent abrasive and debris from the inner blasting chamber of the cabinet housing. The forward open end portion of the cabinet housing is provided with a peripheral resilient seal for making an effective sealing engagement with the surface to be abraded, whether that surface is flat, convex, concave or undulatory.

It is the principal object of the present invention to provide a lightweight portable cabinet housing for enclosing a surface to be abraded in a substantially airtight manner, the cabinet housing providing a means for introducing abrasive material into an inner blasting chamber and an outlet means for exhausting abrasive and debris from the inner chamber to a recycling blasting system so that expulsion of abrasive and debris into the surrounding air is avoided.

It is another object of this invention to provide a portable cabinet device constructed and arranged to be retained upon an upright surface by air pressure alone when the blasting system is connected and operating.

It is a further object of this invention to provide a cabinet housing which can be manually positioned on a surface to be abraded, the interior of the housing being illuminated for viewing by a person during a blasting operation.

Another object is to provide a resilient sealing member peripherally of the open end of the cabinet device, the sealing member being formed of open-cell foam material affording a plurality of tortuous paths in communication with the inner blasting chamber so that the paths are evacuated when air is exhausted from the blasting chamber, the outer lateral surface of the sealing member having a barrier film or strip substantially impervious to passage of air.

BRIEF DESCRIPTION OF THE DRAWINGS

The details of construction and operation of the invention are more fully described with reference to the accompanying drawings which form a part hereof and in which like reference numerals refer to like parts throughout.

In the Drawings.

DESCRIPTION OF THE PREFERRED EMBODIMENT

Figures 1, 2, 3:
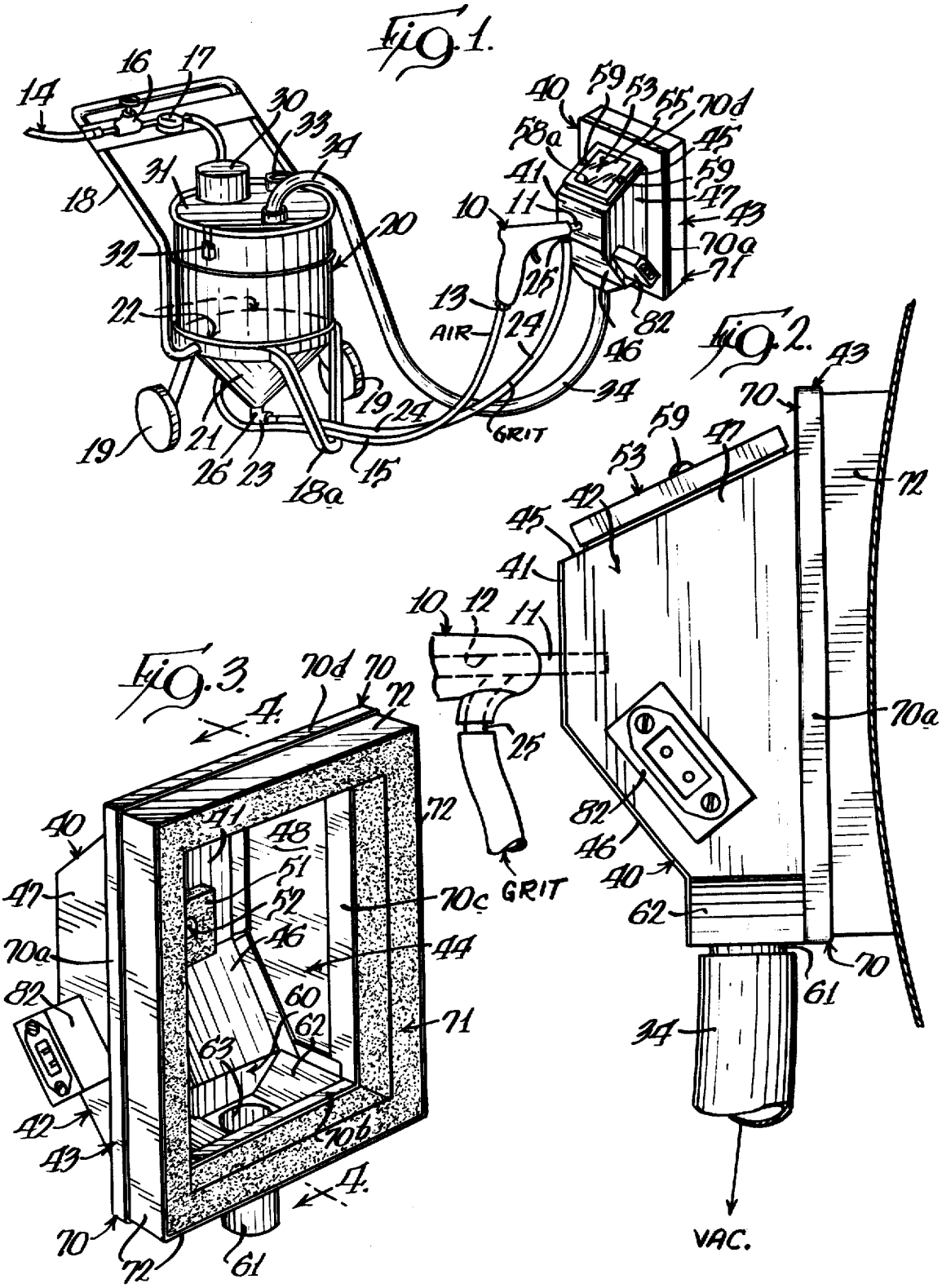
FIG. 1 is a perspective view of the portable abrading cabinet device attached in operative position to the abrasive blasting system.
FIG. 2 is an enlarged broken side elevational view of the cabinet device of FIG. 1 showing the device applied to a convexly curved upright surface, the cabinet device being sustained on the surface by the pressure differential established between the interior and the exterior of the cabinet device.
FIG. 3 is a perspective view taken from the front end portion of the vertically disposed cabinet device to show the sealing member and the inner blasting chamber.

Referring to FIG. 1, the abrasive blasting system of my copending U.S. patent application Ser. No. 909,537 referred to above is shown for use in combination with the portable abrading cabinet device of the present invention. The structure of the abrasive blasting system of my copending application is hereby incorporated by reference in its entirety into the instant application. However, in the present application only that portion of the abrasive blasting system will be described which is necessary to an understanding of the structure, function and results accomplished by the portable abrading cabinet device of the present invention.

The abrasive blasting system includes a sand blasting gun generally designated 10 having a barrel or nozzle 11. A passageway 12 for pressurized air (shown in dotted outline in FIG. 2) extends through the handle and barrel of the gun from a pressurized air source generally designated 14. Air pressure is conducted to the gun by a conduit 15 which is secured to an air inlet fitting 13 at the bottom of the handle of the gun. A pressure regulating valve 16 is provided in the conduit 15 for adjusting pressure flowing to the gun, which pressure is indicated on a pressure gauge 17 mounted in the conduit 15 adjacent the valve 16.

A housing or canister generally designated 20 contains a supply of abrasive material for the blasting system. The housing 20 is mounted on a frame 18 having a front leg **18*a* and a pair of rear supporting wheels 19. The canister 20 has a hopper shaped bottom 21 and the top surface layer of the abrasive material is generally maintained approximately as indicated at 22 so as to leave an open volume in the canister above the top surface layer of the abrasive material. A hopper outlet 23 has an abrasive delivery line or conduit 24 secured thereto at one end. The other end of the conduit 24 is secured to a gun abrasive inlet fitting 25 located downstream of the gun air inlet fitting 13. When the blasting system is in operation, air pressure flowing through the passageway 12 creates a low-pressure condition in the conduit 24 causing ambient air pressure to enter upstream of conduit 24 through aperture means 26 which air stream initiates flow of abrasive material from the canister 20 and carries abrasive material to the barrel 11 of the gun 10**.

A vacuum motor generally designated 30 is mounted in a removable canister lid 31 which is sealed to the top of the canister 20 by a number of lock members 32. When the vacuum motor 30 is actuated, the motor creates a space of decreased air pressure above the top surface 22 of abrasive material in the canister and exhausts air from this space through a filter means and through an outlet 33 to the exterior of the canister 20. A retrieval conduit 34 for abrasive material and debris is detachably secured to the canister lid 31 and the space within the conduit is maintained at a low-pressure to carry abrasive material and debris back to the interior of the canister when the vacuum motor 30 is operating.

As best seen in FIG. 1, a portable abrading cabinet device generally designated 40 is operably incorporated in the abrasive blasting system. The cabinet device 40 includes a cabinet housing of cup-shaped configuration formed by a rear end wall 41 and a skirt-like peripheral sidewall 42 formed integrally therewith. The housing is open at its forward end portion 43, and the cup-shaped configuration of the housing affords an inner blasting chamber 44. As best seen in FIG. 3, the open forward end portion 43 is preferably of rectangular configuration with dimensions of approximately six inches by nine inches. The peripheral sidewall 42 preferably includes upper sidewall element 45 and lower sidewall element 46, each of which diverge outwardly from the rear end wall 41. A second pair of sidewall elements 47, 48 extend forwardly from the end wall 41 to complete the cup-shaped configuration of the housing of the cabinet device 40.

A housing aperture 50 is provided in the rear end wall 41 to closely receive the barrel 11 of the sand blasting gun 10. The aperture 50 is of a size to permit adequate swinging or pivotal movement of the gun 10 so that abrasive material from the gun 10 can be directed throughout the open area within the forward end portion 43 of the cabinet device 40. A piece of resilient material 51 such as rubber is provided with an opening 52 slightly smaller than the aperture 50 and is secured in position on the inner side of the rear end wall 41 so that the aperture 50 and the opening 52 are in alignment. The resilient material 51 about the opening 52 resiliently and yieldably engages the barrel 11 to provide an effective seal about the barrel while allowing the gun and barrel to be pivotally moved during a blasting operation as pointed out above.

Figure 4:
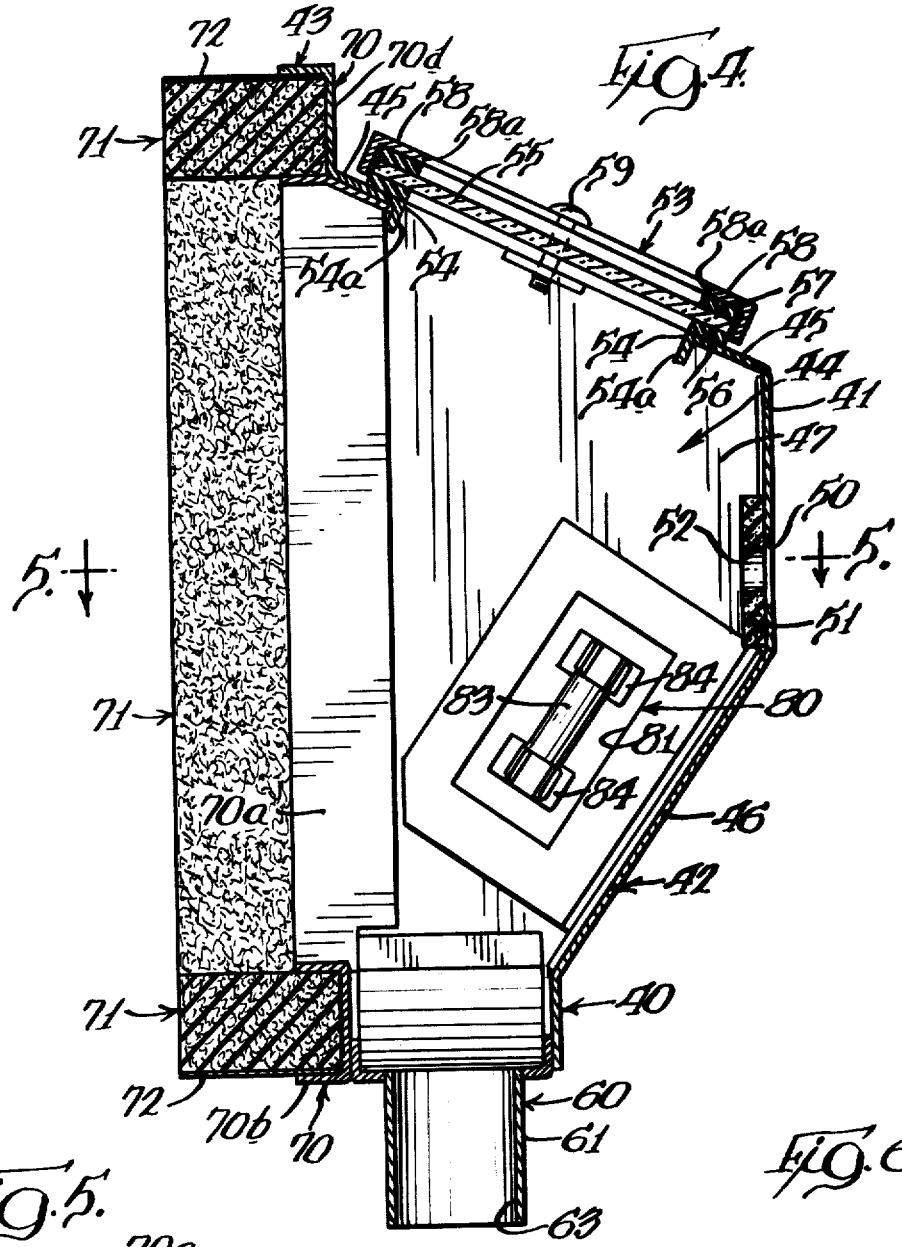
FIG. 4 is a cross-sectional view of the cabinet taken as indicated on line 4—4 of FIG. 3.
Figure 5:
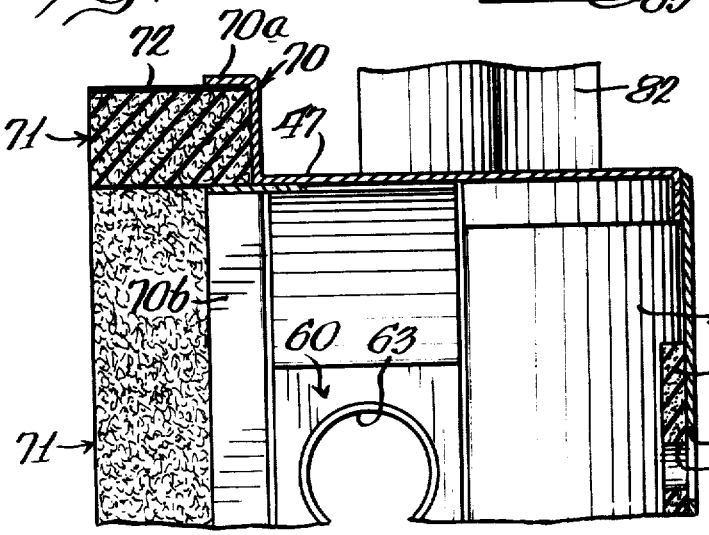
FIG. 5 is a broken cross-sectional view of the cabinet taken as indicated on line 5—5 of FIG. 4.
Figure 6:
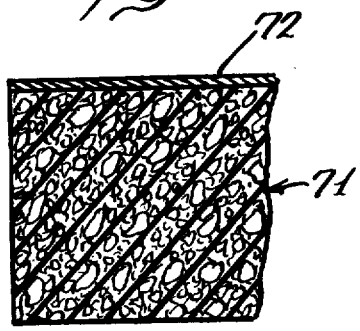
FIG. 6 is an enlarged broken cross-sectional view of a segment of the resilient seal member which is positioned on the seat of the cabinet device shown in FIG. 3.

In order that an operator of the gun 10 may view the inner blasting chamber 44 during a sand blasting operation, a transparent window assembly 53 is mounted in the upper sidewall element 45 as best shown in FIGS. 1 and 4. A rectangular window opening 54 is formed in upper sidewall element 45 which is closed by a rectangular transparent pane 55 of glass or plastic whose peripheral marginal edge portion is nested between an inner rectangular gasket 56 and an outer rectangular gasket 57. The pane 55 and the gaskets 56, 57 are secured in position against sidewall element 45 by a rectangular metal clamping member 58 which is drawn toward gasket 57 by a pair of bolts and nuts 59. The clamping member 58 is provided with a rectangular central opening **58*a* approximately four inches long and three inches wide to permit an operator to view the inner blasting chamber through pane 55**.

A pair of transverse deflector members **54*a* project inwardly of the side wall element 45 and the blasting chamber 44, one extending across the rear side and the other across the forward side of the window opening 54 to assist in deflecting turbulent abrasive and debris within the inner chamber 44 away from the inner surface of the window pane 55** during an abrading operation.

The lower sidewall element 46 terminates forwardly and downwardly in an exhaust outlet means 60 which has an exterior fitting 61 of a size to be detachably connected to the abrasive retrieval conduit 34. Since the cabinet device 40 is generally used in an upright position as shown in FIG. 2, the exhaust outlet means 60 is positioned at the extreme lower end of the cabinet device 40 to facilitate the egress of abrasive material and debris from within the blasting chamber 44 under the influence of gravity and the partial vacuum existing within the abrasive retrieval conduit 34 during a blasting operation. The exhaust outlet means 60 includes a funnel-shaped portion 62 to facilitate the guiding of spent abrasive and debris to an opening 63 in the fitting 61.

Means are provided in the forward end portion 43 of the cabinet device 40 for making a substantially airtight sealing engagement with a surface to be abraded so as to provide a pressure differential between the inner blasting chamber and the exterior of the cabinet device 40. To this end, a channel-shaped seat member 70 is provided which is secured to the forward marginal edge portions of sidewall elements 45, 46, 47 and 48 and extends peripherally of the forward end portion 43. Preferably, the seat member 70 is rectangular so as to afford similarly formed seat segments 70*a*, 70*b*, 70*c* and 70*d*.

A resilient sealing means 71 is secured within the seat member 70, the securement preferably being accomplished by the use of a well-known adhesive. The sealing means is thus also preferably rectangularly formed and is shaped so that its rearward rectangular portion makes a snug fit within the channel-shaped seat member 70. The sealing means is preferably of low durometer hardness and readily and easily resiliently flexes. As herein shown, the sealing means is formed from a very soft foam rubber which has an open cellular internal structure affording a multitude of tortuous paths or passageways in air-flow communication with the inner blasting chamber 44. This structure enables the sealing means to conform to any surface irregularities or to a gradually or sharply curved surface upon which the cabinet device may be used. In addition to facilitating the airtight engagement of the cabinet with the work surface, the foam rubber absorbs the ricocheting abrasive within the inner blasting chamber without excessive wear over a prolonged period of time. In the instant invention, a sealing means having a cross section of about one inch square has been found to be sufficient to insure the maintenance of a positive seal while at the same time being small enough to maintain the proper flexing capabilities.

The peripheral exterior lateral wall surface of the sealing means 71 is preferably entirely covered with a flexible barrier strip or film 72 secured thereto. The strip 72 is substantially impervious to the passage of air so as to prevent the ingress of ambient air during a blasting operation through the interstices of, and the passageways in, the open cellular structure of the foam rubber. Thus when the inner blasting chamber is being exhausted of air during a blasting operation, the passageways in the open-cell foam rubber are likewise being exhausted of air so that ambient air pressure upon the exterior of the cabinet device collapses the foam rubber sealing means against and into intimate engagement with the surface to be abraded. The barrier strip 72, being flexible, does not inhibit or prevent compressing of the foam rubber throughout the sealing means. Further, the weight of the cabinet device, the area of the cabinet device exposed to ambient air, the pressure differential established, and the effectiveness of the sealing means is such that the cabinet device will be sustained without manual support upon a vertical surface (FIG. 2) during a blasting operation.

In some instances, open-cell polyurethane may be used as the sealing means rather then open-cell foam rubber. Generally, however, the polyurethane foam is slightly harder (higher durometer rating) than foam rubber and consequently it does not function quite as effectively in a sealing vapacity as does the open-cell foam rubber. The cross section of the sealing means may be varied depending upon the type of material being used.

Within the inner blasting chamber 44, illuminating means, generally designated 80, are included so that an operator may clearly view the surface being abraded during an abrading operation. A cubical recess 81 is formed in the inner surface of the sidewall element 47 immediately adjacent an electrical receptacle 82 secured to the outer surface of the sidewall 47. A small elongated 12 volt lamp 83 of cylindrical configuration is snap-fit within a pair of U-shaped resilient conducting arms 84 which are electrically connected to the exterior receptacle 82. The 12 volt lamp is actuated by an external power source operating through a stepdown transformer (not shown) which is operatively and detachably electrically connected to the electrical receptacle.

Referring generally to the construction of the portable cabinet device 40 in its preferred form, the inner blasting chamber is approximately nine inches long, six inches wide and five to six inches deep. The cabinet device may be fabricated from sheet steel of approximately 20 gauge thickness in its preferred form or, alternatively, it may be formed integrally of a durable plastic, such as a polycarbonate. When fabricated from metal, various portions of the cabinet device may be die-formed stampings which are integrally formed into an airtight cabinet device 40 by spot welding. The metal cabinet device constructed as above weighs approximately four pounds. At this weight, the cabinet device is self-sustaining when the inner blasting chamber is evacuated by the external atmospheric pressure bearing against the exterior of the cabinet device, even when the cabinet device is utilized on a vertical surface or when placed on the underside of a generally horizontal surface to be abraded.

The blasting system in which the instant invention is used is generally considered to be a low-pressure system. In other words, the pressurized air source 14 is generally operated between 40 and 90 psi. The blasting system and the instant cabinet device is particularly adapted for use in an automobile body-fender shop to repair automobile surfaces, although not limited to such use.

Because the interior blasting chamber 44 of the cabinet device 40 during operation is kept at low pressure by the partial vacuum established within abrasive retrieval line 34, and air and abrasive under pressure is being introduced into chamber 44 from the gun 10, an extremely turbulent and ricocheting action is imparted to the abrasive within the blasting chamber. It has been observed that generally the confined rebounding abrasive tends to follow in large part the general contour or curvature of the interior of the cabinet device 40. Thus the transverse deflectors 54*a* aid substantially in shielding and deflecting such rapidly moving abrasive to protect the window pane 44 from internal abrasion.

The present invention provides an improved structure for carrying out a blasting operation on surfaces of varying size and shape and varying accessibility. It is small, manually portable, and captures and returns debris for filtering to obviate the need for an exhaust through a building wall to outside atmosphere. It enables the operator to view the progress of the abrading action through a protected transparent pane and by utilizing an illuminated blasting chamber interior. Importantly, the cabinet device has a unique sealing means enabling the device to be self-supporting on surfaces being abraded regardless of the angular disposition of such surfaces. Thus when the blasting chamber is being exhausted of air, an operator need not hold the device in operative position either when the abrading gun is being used or when it is not being used.

The foregoing description is given for clearness of understanding only and no unnecessary limitations should be implied therefrom, as modifications will be obvious to those skilled in the art.

I claim:

1. In an abrasive blasting system including an abrading device having a canister containing a supply of abrasive material and having an outlet at the bottom thereof, a source of vacuum connected to the canister and applying a negative pressure to the upper surface layer of said abrasive material, a gun having a barrel for directing abrasive material in the direction of a surface area to be abraded and having a passageway therethrough, a source of positive pressure air connected to one end of said gun passageway, a first conduit connected to the canister above said abrasive material for returning abrasive material and abraded debris to the canister, a second conduit having a first end portion connected to the canister outlet and a second end portion connected to said gun passageway downstream of the connection of said source of positive pressure to said gun, and means for causing abrasive material to flow toward the gun in said second conduit, a portable abrading cabinet device in which an abrasive blasting operation is performed on articles to be abraded, comprising:

a cabinet housing of cup-shaped configuration formed from a rear end wall and a skirt-like peripheral sidewall secured together to provide a forward open end portion and to afford an inner blasting chamber within the housing;

aperture means in the cabinet housing of a size to accommodate the gun barrel for pivoting movement to direct abrasive toward the work surface;

a transparent window member mounted in the cabinet housing for viewing the inner blasting chamber and the work surface during the blasting operation, the window member being spaced upwardly from the aperture means;

exhaust outlet means in the cabinet housing adapted to be connected to the first conduit for removing abrasive material and abraded debris from the blasting chamber, said exhaust outlet means being positioned below said aperture means;

a seat member extending peripherally of the forward open end portion of the housing;

and a resilient peripheral sealing means secured to the seat member, the sealing means projecting forwardly of the seat member to provide sealing engagement with a work surface to be abraded when the first conduit is exhausting air from the inner blasting chamber.

2. A portable abrading cabinet device as specified in claim 1 in which the sealing means is formed of resilient foam material.

3. A portable abrading cabinet device as specified in claim 1 in which the sealing means is formed of resilient open-cell foam material affording a plurality of tortuous paths for air in said foam material, the foam material having an exterior peripheral lateral surface provided with a flexible barrier which is substantially impervious to the passage of air so that the tortuous paths and the inner blasting chamber are being exhausted of air when the blasting system is in operation and the sealing means is in engagement with a work surface to be abraded.

4. A portable abrading cabinet device as specified in claim 3 in which the foam material is a foam rubber of relatively low durometer hardness to permit the rubber to be easily compressed against the contour of the surface being worked.

5. A portable abrading cabinet device as specified in claim 1 in which the cabinet housing is of such size and weight so that during operation of the blasting system the cabinet housing will be retained on an upright surface being worked by the pressure differential between ambient air pressure and the lesser air pressure within the inner blasting chamber.

6. A portable abrading cabinet device as specified in claim 1 in which the cabinet housing includes a funnel-shaped portion which opens into the exhaust outlet means.

7. A portable abrading cabinet device as specified in claim 1 in which deflectors are provided extending inwardly from the periphery of the window member to minimize impingement of abrasive material upon the window member within the inner blasting chamber.

8. A portable abrading cabinet device as specified in claim 1 in which light means are provided within the cabinet housing to illuminate the inner blasting chamber during operation of the blasting system.

* * * * *